US005967895A

United States Patent [19]

Kellen

[11] Patent Number: 5,967,895

[45] **Date of Patent: *Oct. 19, 1999**

[54] PORTABLE ELECTRONIC BINGO DEVICE

[75] Inventor: William G. Kellen, Cora, Wyo.

[73] Assignee: Bettina Corporation, Burbank, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,433

[22] Filed: Sep. 13, 1996

Related U.S. Application Data

[60] Provisional application No. 60/003,707, Sep. 13, 1995.

[51] Int. Cl.[6] ..... A63F 3/06

[52] U.S. Cl. ..... 463/19; 463/25; 463/44; 463/45; 273/269

[58] Field of Search ..... 463/19, 44, 45; 273/269

[56] References Cited

U.S. PATENT DOCUMENTS

| | | | |
|---|---|---|---|
| 4,768,151 | 8/1988 | Birenbaum et al. | 273/269 |
| 5,482,289 | 1/1996 | Weingardt | 273/269 |

OTHER PUBLICATIONS

Bingo Wizard Handheld Electronic Bingo Players Aid, Charles Larson, 1996, Control Resources, Ltd., 19042 San Jose Ave., P.O. Box 8694, Rowland Heights, California 91748, Phone: 818–912–5722 (unpublished).

Bingo Circuit Schematic, five (5) pages, Charles Larson, (unpublished).

Arial6.C, pp. 1–14, Charles Larson, 1996 (unpublished).

Bingo.H, pp. 1–3, Charles Larson, 1996 (unpublished).

Bingo.C, pp. 1–11, Charles Larson, 1996 (unpublished).

Bingo HW.H, one page, Charles Larson, 1996 (unpublished).

Bitmaps.C, pp. 1–7, Charles Larson, 1996 (unpublished).

CAT UI.H, one page, Charles Larson, 1996 (unpublished).

Display.C, pp. 1–6, Charles Larson, 1996 (unpublished).

Display.H, one page, Charles Larson, 1996 (unpublished).

GDI.C, pp. 1–7, Charles Larson, 1996 (unpublished).

GDI.H, pp. 1–3, Charles Larson, 1996 (unpublished).

GDISUBS.C, pp. 1–4, Charles Larson, 1996 (unpublished).

IOADDR.H, one page, Charles Larson, 1996 (unpublished).

Kernal.C, pp. 1–7, Charles Larson, 1996 (unpublished).

Kernal1.C, pp. 1–5, Charles Larson, 1996 (unpublished).

Keyboard.C, pp. 1–5, Charles Larson, 1996 (unpublished).

LCDINTF.C, pp. 1–15, Charles Larson, 1996 (unpublished).

LCDlines.H, pp. 1–4, Charles Larson, 1996 (unpublished).

Longnum.C, one page, Charles Larson, 1996 (unpublished).

Longnum.H, one page, Charles Larson, 1996 (unpublished).

STDTYPES.H, one page, Charles Larson, 1996 (unpublished).

*Primary Examiner*—Benjamin H. Layno

[57] ABSTRACT

An electronic bingo device for use in dispensing bingo cards and tracking the cards for bingo during play. The apparatus is equipped with a conventional computer hardware platform and software tailored to track a bingo game by use of a game key with memory for storing data representative of a set of bingo game data including winning patterns and wild cards used during each game. In addition, a player's allocation of bingo cards are stored on the game key. Bingo cards stored in the device corresponding to the number allocated are used for game play. As the player enters the numbers are called out in the bingo hall. The device monitors each card for bingo.

16 Claims, 12 Drawing Sheets

| | | | | | | | | | | |
|---|---|---|---|---|---|---|---|---|---|---|
| 88 | 88 | 88 | 88 | 88 | | 88 | 88 | 88 | 88 | 88 |
| 88 | 88 | 88 | 88 | 88 | | 88 | 88 | 88 | 88 | 88 |
| 88 | 88 | 88 | 88 | 88 | | 88 | 88 | 88 | 88 | 88 |
| 88 | 88 | 88 | 88 | 88 | | 88 | 88 | 88 | 88 | 88 |
| 88 | 88 | 88 | 88 | 88 | | 88 | 88 | 88 | 88 | 88 |
| | | | | | | | | | | |
| 88 | 88 | 88 | 88 | 88 | | 88 | 88 | 88 | 88 | 88 |
| 88 | 88 | 88 | 88 | 88 | | 88 | 88 | 88 | 88 | 88 |
| 88 | 88 | 88 | 88 | 88 | | 88 | 88 | 88 | 88 | 88 |
| 88 | 88 | 88 | 88 | 88 | | 88 | 88 | 88 | 88 | 88 |
| 88 | 88 | 88 | 88 | 88 | | 88 | 88 | 88 | 88 | 88 |

FIG. 7

| |
|---|
| <CLEAR> |
| [0..9].. <ENTER> |
| [0..9].. <WILD><ENTER> |
| [0..9].. <DELETE> |
| [0..9].. <WILD><DELETE> |
| <INFO> |
| <BINGO BOARD> |
| <VIEW CARDS> |
| [0..9].. <VIEW CARDS> |
| <NEXT GAME> |
| [0..9].. <NEXT GAME> |

FIG. 8

PORTABLE ELECTRONIC BINGO DEVICE

This application claims the benefit of U.S. Provisional Application No.: 60/003,707 filing date Sep. 13, 1995.

BACKGROUND OF THE INVENTION

1. Field of the Invention

The present invention relates to a portable electronic game system and more particularly to a stand-alone electronic bingo game apparatus.

2. Description of the Related Art

Bingo is game of chance in which each player's chances of winning depends upon numbers drawn at random. Players compete in against other using bingo cards prepared with a design of five rows of five squares each for a total of 25 squares. The letters B-I-N-G-O is displayed above the grid, with each letter aligned with a vertical column of squares. A two-digit number generally from 1 to 99, but preferably from 1 to 75, appears in every square of the bingo card except the center square, which is designated as a free play. The game also uses a central source for generating random numbers. The random numbers are drawn from a pool of bingo balls. The number of balls corresponds to the range of numbers available on the bingo card. On each ball are found letters and numbers corresponding to those printed on the bingo cards. Each ball includes one letter from the word bingo and one number from the range of numbers printed on the bingo card. From a conventional air-ball machine or a box, a caller chooses numbers at random one ball at a time and announces the letter and number appearing on the ball. The players with numbers matching the number on the ball called, marks off the number being called using a ink marker called a "dauber". In the basic form of bingo, as soon as five numbers are covered in a straight line either vertically , horizontally or diagonally, the person with the covered numbers calls out "bingo!". Each player that attains "bingo" in a game wins a prize. At the end of each game players turn in their marked cards and must purchase new cards to play another round. Players generally have an opportunity to play more than one bingo card. Often players may attempt as may bingo cards as they have table space available with the idea that the more cards played increases the player's chances of winning bingo. Bingo cards are often sold prepackaged in groups of various denominations. Players can purchase these packaged cards as an added convenience.

With the growth in popularity for the bingo game, more challenging changes have added to the bingo game. First, the basic winning patterns of aligning five numbers on a card either horizontally, vertically or diagonally have been supplemented by a number of complex winning patterns. Some of these winning patterns are as follows:

Postage Stamp where winning numbers are found only in one corner of the array;

Four Corners where winning numbers are found in every corner of the array;

Small Diamond where four winning numbers are found encircling one cell in the array;

Block of Nine where winning numbers are found in a three by three array forming a block of nine numbers;

Crazy T where winning numbers are aligned in a horizontal line and a vertical line to form a "T" shape;

Large Diamond where winning numbers are aligned diagonally encircling a small diamond;

Small Picture Frame where eight winning numbers are found encircling one cell in the array; and Crazy L where winning numbers are aligned in a vertical line and horizontal line to form an "L" shape.

In addition, some bingo halls are now using "wild numbers" to further add to the complexity of the game. The "wild numbers" are typically called out at the beginning of game play. A "wild number" is identified by the caller before it is drawn. The caller also identifies what characteristic will make the number wild. For example, if the number is even then all even numbers may be marked. Or for example, all numbers sharing the same first digit may also be declared as wild. Other, criteria may be used as well, but it is generally the bingo hall that determines the rules for each game.

Wild card numbers and the winning patterns generally change for each bingo game. In order to achieve "bingo" during any game, the players must know the rules and apply the rules properly during each called number in order to achieve bingo. A problem occurs with players accustomed to playing large numbers of bingo cards. The complexity of tracking several winning numbers for each game combined with the large number of cards played, often increases the chances that a players will miss a possible winning match.

Electronic bingo devices have been developed to help alleviate the problem of tracking large numbers of bingo cards over various patterns; however many of these devices are not well suited for complexities of game play available. While other devices which are well suited for such game play are complex and require computer operators to load the game information before use. One such device is disclosed in U.S. Pat. No. 4,747,600 issued to Richardson which describes a gaming board which includes a communications port used in an electronic bingo system. A computer operator transfers individual game player cards and winning pattern information to the gaming boards from a base station computer. This method has to be performed on each gaming board used in play. The result is added cost and labor to the bingo hall. Another problem with the electronic bingo system is that each game board must be individually connected to the base station in order to be connected. This causes added delay as each player must wait for the operator of the base station to configure their system. Thus, the need exists for a low cost, easy-to-use bingo device that is capable of adapting to the various levels of game play.

OBJECTS AND SUMMARY OF THE INVENTION

It is an object of the present invention to provide a low cost and easy-to-use portable electronic bingo device adaptable for use in a variety of bingo type games.

It is another object of the present invention to provide a portable electronic bingo device that is easy to configure for various bingo games.

It is an advantage of the present invention to manually configure the bingo device for game play.

It is a feature of the present invention to include a plurality of game keys, each comprising specific bingo game information such as winning patterns and the desired number of bingo cards, that when inserted manually into the bingo device configures the bingo device for game play.

In accordance with the objects, advantage and feature of the present invention, an electronic bingo device is provided with a manually received game key to aide players in the game of "bingo". The game key activates the device for game play and includes winning pattern information, the number of games to be played in the hall and a predetermined number of bingo cards to be selected from a set of bingo cards stored in the memory of the bingo device. A variety of game keys are available in the bingo hall, where the game keys are sorted according to the number of bingo cards to be selected from memory.

The electronic bingo device is comprised of a display permitting the simultaneous presentation of up to four bingo cards. A keyboard provides a user interface for entering numbers as the numbers are called out during play, changing the displayed information and updating the winning patterns as the game play progresses or a new game is started. An audible alarm is included to indicate when a card has won bingo. These various user interfaces are controlled by a central processing unit (CPU) under the control of software. The electronic bingo device is equipped with a memory containing bingo cards within the range of 1,000 to 10,000 unique numerical arrangements of bingo cards. The allocation number, provided by the game key, identifies the number of cards allocated to the player at random from the list bingo cards stored in the device's memory. The game, when purchased for use during the evening, is fully assembled and operated when the game key is inserted into the electronic bingo device. The game is manually inserted into the device and includes all of the necessary information to join in rounds of bingo. Upon power-up, the game cards are selected from the list of bingo cards unique to that particular portable device. The winning pattern information and number of games information is used by a control program in the portable bingo device to configure the device for that evening's bingo play.

When in use, the game device will display up to four cards at a time during game play. In a "best mode" display, the cards are arranged in descending order according to the cards which are most likely to complete a winning pattern. The user may scan through the bingo cards in play using the keyboard. The user will enter numbers as they are called out by the bingo-hall announcer into the bingo device. As each number is entered, the device will check and compare that number against the game cards in play during that game. The bingo cards will then be checked against the winning patterns and the order of the cards will be adjusted if in "best mode" to display bingo cards having the greatest likelihood of winning. Other features and advantages of this invention will be made apparent upon review of the drawings and detailed description of the invention.

BRIEF DESCRIPTION OF THE DRAWINGS

The objects and advantages of the present invention will become more readily apparent to those ordinarily skilled in the art after viewing the following detailed description and accompanying drawings wherein:

FIG. 7 is a diagram of a bingo display of the present invention;

FIG. 8 is a table of valid player entries; and

DETAILED DESCRIPTION

Figure 1:
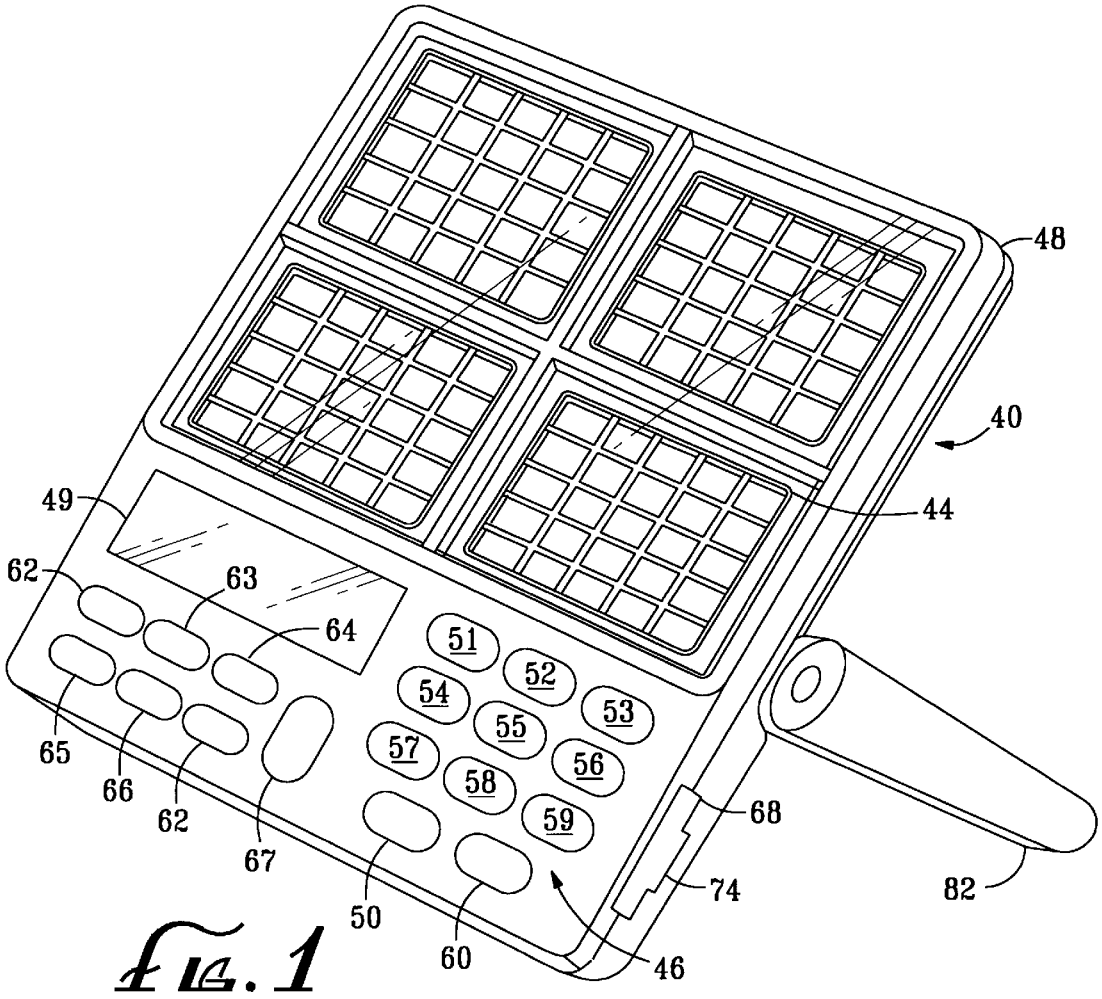
FIG. 1 is a perspective front view of the present invention.
Figure 2:
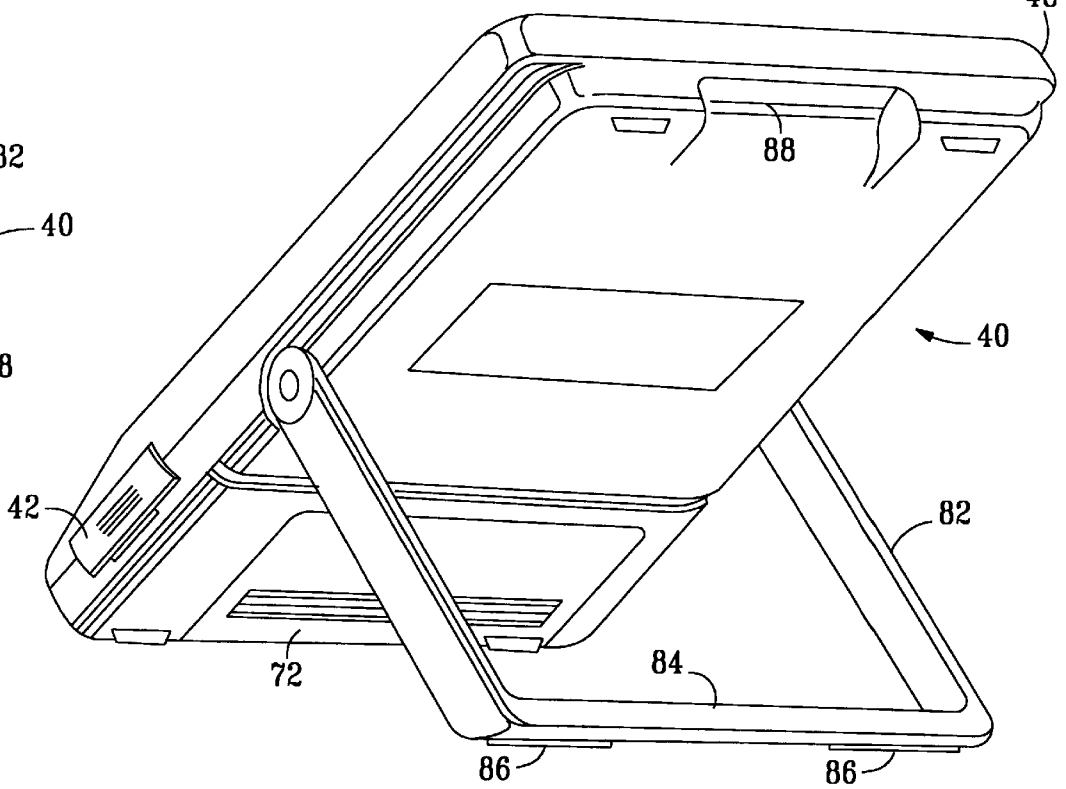
FIG. 2 is a perspective rear view of the present invention.
Figure 3:
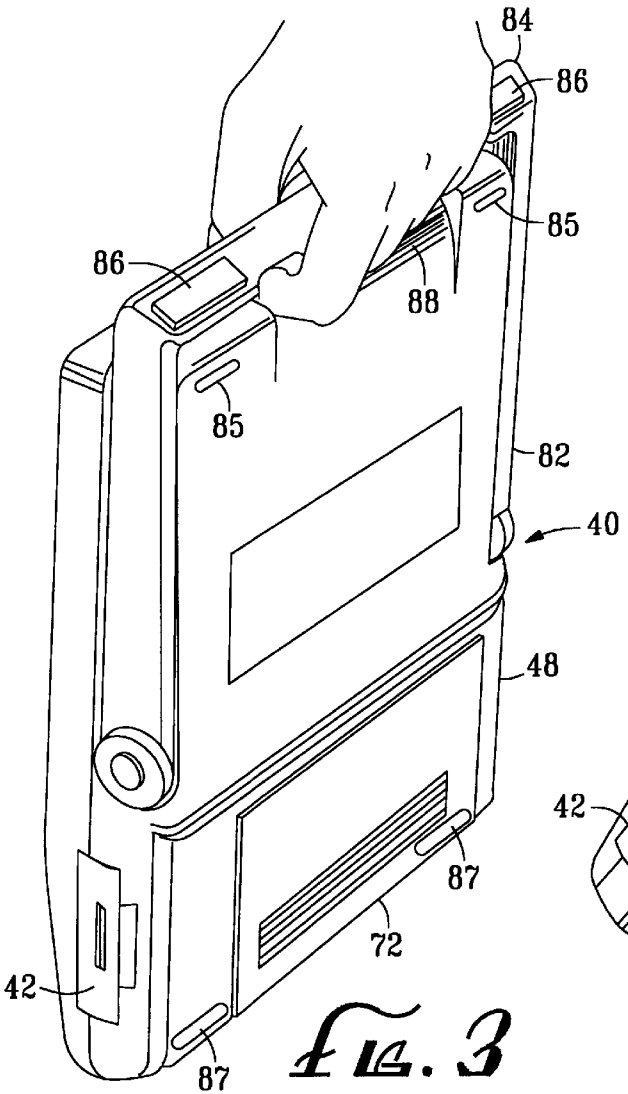
FIG. 3 is a perspective view of the present invention.
Figure 4:
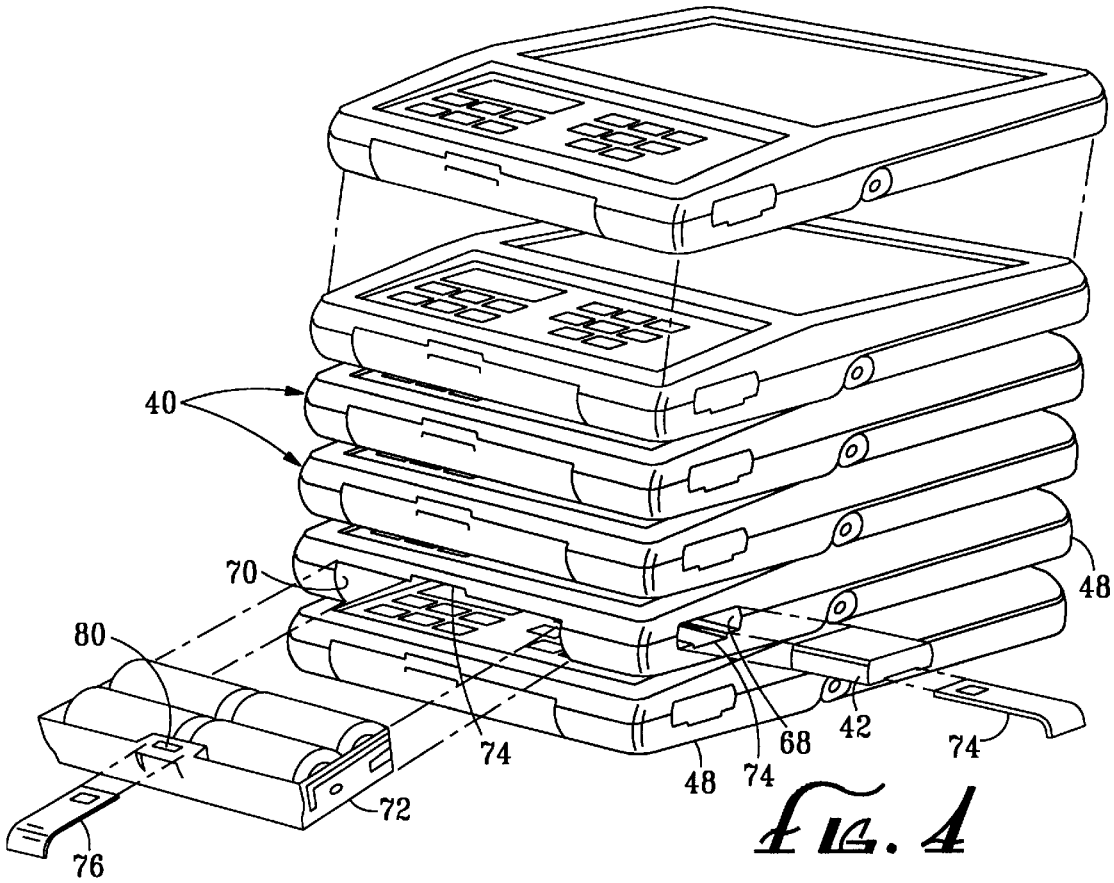
FIG. 4 is an exploded view of a set of devices of the present invention.
Figure 5:
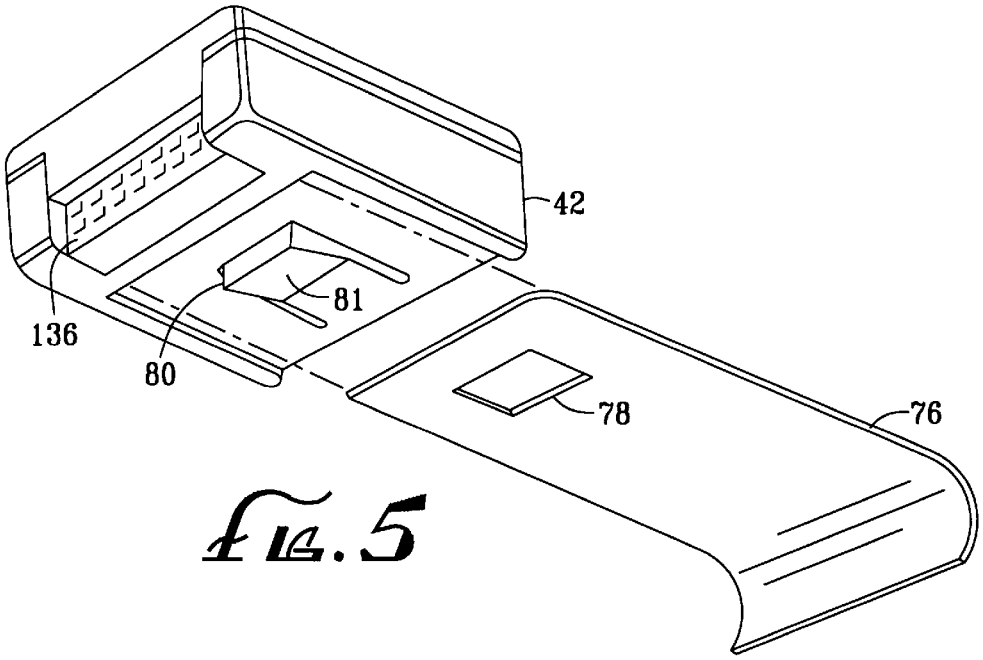
FIG. 5 is a perspective view of a game key of the present invention.

As shown in the drawings for purposes of illustration, the invention (FIGS. 1–5) is embodied in an electronic bingo device 40 in which bingo cards are provided stored therein and, when activated by the mechanical receipt of a game key 42 (FIGS. 2–5), is adapted to operate with a bingo player in accordance with the rules of play defined by the bingo hall. The game keys 42 are inserted by the bingo hall personnel from an assortment of game keys that are sorted according to the quantities of bingo cards provided by the bingo hall. A visual display 44 (FIG. 7) provides preferably four different bingo cards at a time. A user keypad 46 (FIG. 1) allows the player to input bingo numbers during game play. The bingo device is presently configured to operate in a "Best Card" mode, a "Browse Cards" mode, a "Bingo Board" mode and an "Information" mode during game play to help the player track bingo cards and to monitor that the device is operating under the correct rules of game play.

THE USER INTERFACE

In accordance with the present invention, the bingo device 40 is housed within a two part molded plastic housing 48. The front face of the housing includes a display 44 having four individual bingo displays each capable of displaying a 5×5 array of bingo card numbers. Below the main display 44 is a supplemental display 48 equipped for displaying alphanumeric information. The supplemental display can provide messages such as a low battery warning or bingo hall notices. Also on the front face and situated below the main display in a user friendly manner is the key pad. Keys 50–59 designated for numbers 0–9 are configured to the right side of the display in an array starting with number "1" 51 in ascending order from left to right and top to bottom ending with number "9" 59, with number "0" 50 located under the array. An enter key 60 is located below the array adjacent the number "0" key. A delete key 61 is located adjacent the numeric keypad and positioned to define a boarder between the numeric keys 50–60 and function keys 62–67. The function keys 62–67 are arranged in two rows of three keys each and provide access to the various display modes, allow for viewing of the bingo cards, promote changing of winning patterns and clears player memory. These functions will be discussed in greater detail herein and are achieved using the following keys: an "information" key 62, a "Bingo Board" key 63, a "Wild" key 64, a "next Game" key 65, a "View Cards" key 66 and a "Clear" key 67.

Located on the side of the housing (FIGS. 1–4) is a key hole 68 for securing the game key 42 (FIGS. 2–5) within the device. In addition, to the game key hole, a battery slot 70 (FIG. 4) is provided along the under side of the device. A battery tray 72 is secured within the slot 70. The game key 42 and the battery tray 72 when engaged in the respective slots provide no surface to conventionally grasp and remove them and are essentially locked in place. An access slot or recess 74 is provided adjacent the game key hole 68 and the battery slot 70. A special tool 76 (FIGS. 4 and 5), comprising a hardened plastic or metallic bar type material and having an eyelet 78, is adapted for insertion into the access slot 74. Both the battery tray 72 and the game key 42 include a wedged tooth 80 having a sloping surface 82 facing the opening of the slot. The tooth 80 is adapted to fit within the eyelet 78 and as the tool 76 is removed the tooth engages the tool 80 about the periphery of the eyelet 78. Thus, using the tool 76, the battery tray 72 and game key 42 may be withdrawn from the bingo device. The tool 76 provides added security in that the game key 42 cannot be removed or tampered with without using a tool 76.

With reference to (FIGS. 1–3), a rotatable U-shaped handle 82 and table stand is hingedly attached to opposing sides of the device. The free end 84 of the handle includes rubber grips 86 to prevent sliding of the device along a table surface. A contoured recess 88 in the backside of the housing located where the free end 84 of the handle may be rotated to overly the housing provides access for an individual to grip the handle 82 when overlying the case. Thus, the handle functions as a handle for transporting the device when the free end is aligned with the housing and as a support for positioning the device in an upright position when the free end is in spaced apart relation to the housing. The devices 40 are stackable for storing (FIG. 4) and include lips 84 and 86 positioned along opposite ends of the back of the device and adapted to engage against recesses in the upper surface of an overlying device.

THE HARDWARE CIRCUITRY

Figure 6:
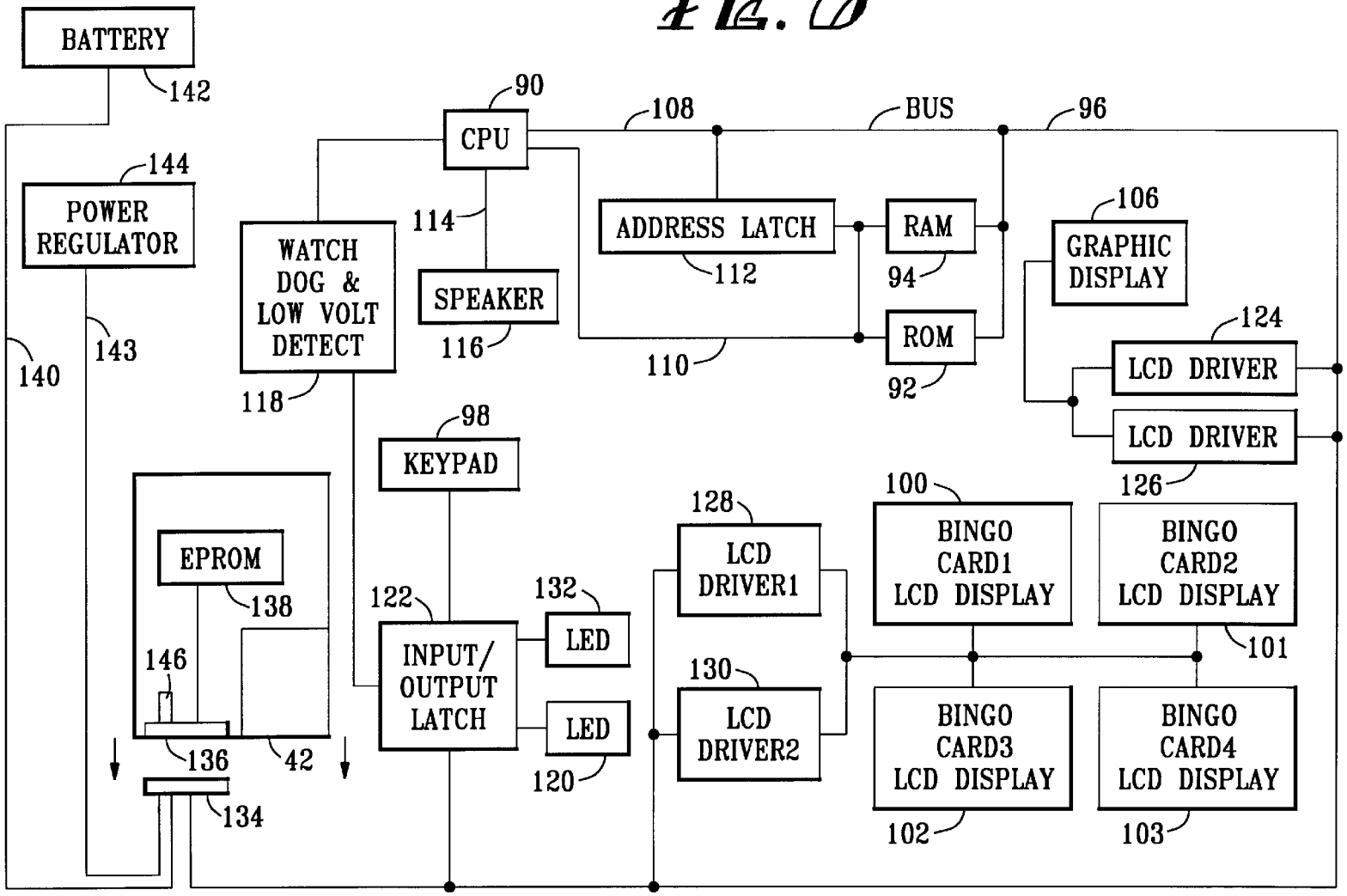
FIG. 6 is a functional block diagram of the hardware of the electronic bingo device of the present invention.
Figure 9:
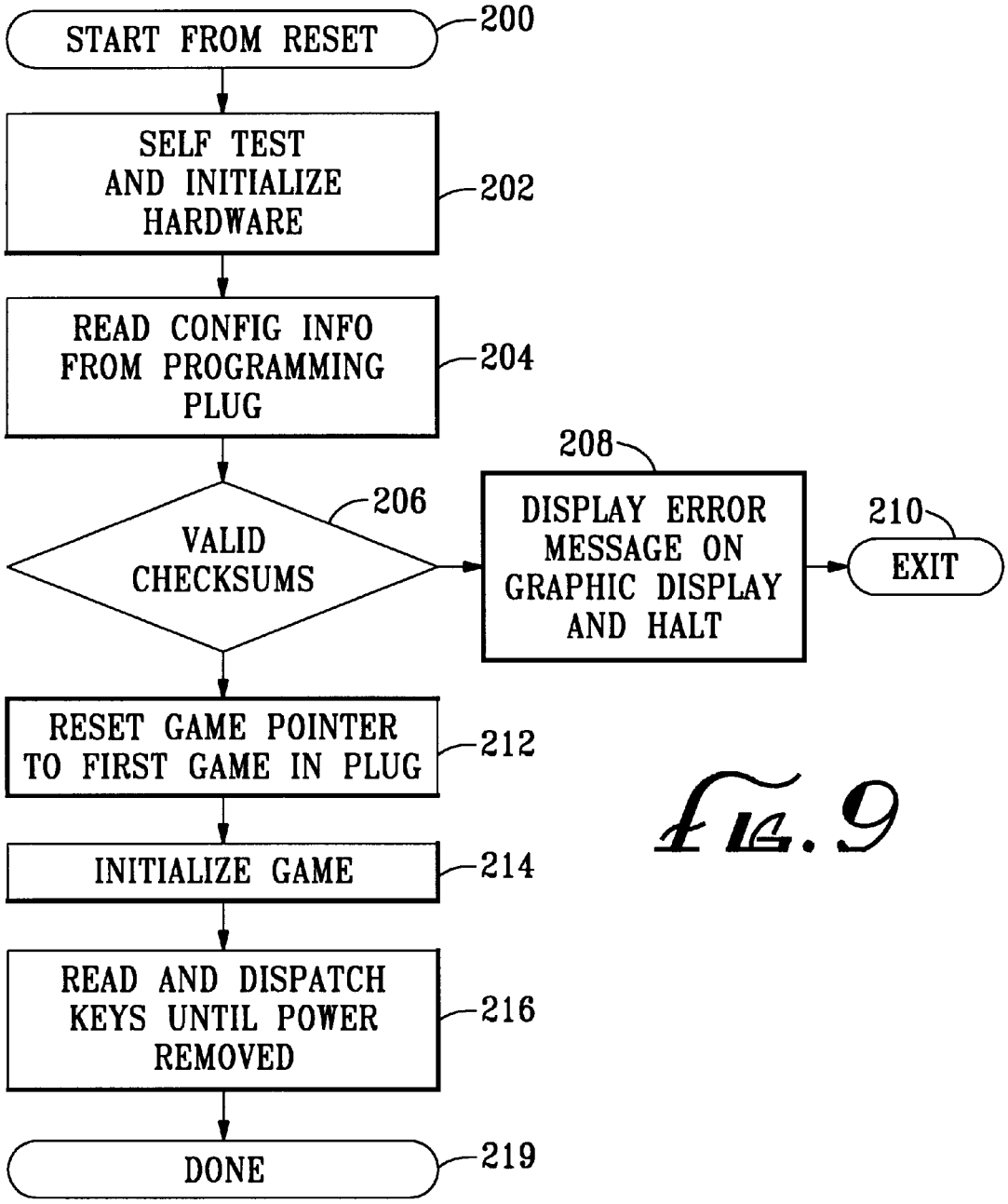
FIGS. 9–15 are flow diagrams of the software program of the present invention.

The electronic bingo device 40 is controlled by a 16-bit central processing unit (CPU) 90 (FIG. 6) operating in cooperation with a control program stored in a read-only-memory (ROM) 92. Upon activation of the CPU the control program is executed from ROM using a 128K×8 bit random-access-memory (RAM) 94 for data storage. The CPU 90 includes an 8-bit data bus 96 which connects the CPU 90 to the key pad 98 and displays 100–104 and 106. A CPU of the type suitable for this purpose is Model 80L188 manufactured by AMD of Sunnyvale, Calif. Separate data and address leads 108 and 110 extend from the CPU 90 to form the data bus 96. Address leads 110 extend to the RAM 94, ROM 92 and an address latch 112 on the data bus 96. Data from the RAM 94 and ROM 92 is communicated back to the CPU 90 through the data leads 108.

The RAM 94 provides the memory space to store the control program and control program data during game play. A RAM of the type suitable for this purpose is model no. TC518128 manufactured by Toshiba of Irvine, Calif. The ROM 92 includes memory space to house the control program and data representative of at least 1,000 bingo cards. A ROM of the type suitable for this purpose is model no. 29F010 manufactured by AMD of Sunnyvale, Calif. operating in cooperation with a data latch of type manufactured by National Semiconductor of Santa Clara and sold as model no. 74LVX245.

The data representative of at least 1,000 bingo cards includes 25 numbers between 1 and 75 randomly chosen for each of the bingo cards and requires 13 bytes for each card or at least 13 kilobytes of ROM memory. The card cells are numbered from 0–24 in which this numbering identifies bits in the patterns and the storage of numbers in the games in play arrays. It will be appreciated by those skilled in the art that storing each of the numbers for each cell conventionally would require at least one byte for each cell or 25 bytes per card. In order to save memory space and cut down on the memory costs, the data has been compressed using a canonical numbering system in using integer numbers from 0 to approximately 6.076911214672×10^27 in such a way that every integer represents a card and every possible card is represented by a single integer. It has been determined that there are a total of approximately 6.076911214672×10^27 possible combinations of bingo cards using 25 numbers selected from a range from 1 to 75.

The CPU 90 includes a sound lead 114 directly connected to a conventional piezo-electric audio transducer 116. The CPU 90 through the use of an internal clock alternates the frequency of the output voltage to the speaker 116 to generate various conventional tones. A watch dog and low voltage detect circuit 118 conventionally monitors the CPU 90 operation by timing the delays in the program loops. If a delay is too long, the watch dog 118 assumes the program has an error and a reset command is sent to the CPU 90. In a likewise conventional fashion, the watch dog 118, senses for a low voltage level by comparing the voltage to a threshold value. If the voltage falls below the threshold a warning signal is sent to a Input/Output latch 122 and is read by the CPU 90.

The CPU 90 uses the data bus 96 to transmit display information to the display panels 100–104 and 106 and to receive user input from the keypad 98. Thus the data base 96 functions to link the CPU 90 with the user interface.

The graphic information display panel 106 connects to the CPU 90 and data bus 96 through a pair of LCD drivers 124 and 126 of the type manufactured by JRC of Mountain View, Calif. and sold under model no. NJU6450. The graphic display is preferably a 3 inch by 1 inch graphic liquid crystal display (LCD) comprising a resolution of 100×32 individually addressable pixels or a type suitable for providing an alpha-numeric display.

The bingo card displays comprise four separate displays 100–104 that connect to the CPU 90 and data bus 96 through a pair of LCD drivers 128 and 130 of the type manufactured by JRC of Mountain View, Calif. and sold under model no. NJU6450. The bingo card displays 100–104 when combined (FIG. 7) comprise an array of 100 two-digit numeric cells arranged from four arrays of five column by five row bingo cards. In addition to control over the seven line segments 129 that make up each digit of each cell, the CPU also addresses and controls the background field 131. This allows the CPU to create the appearance of blacked-out or inverted cells, to indicate that the number in the cell has been entered by the user.

The input/output (I/O) latch 122 connects the keypad 98 to the data bus 96 and senses the key pad 98 for entries made by the bingo player. Upon recognizing a data entry, the latch loads in the data from the keypad and awaits permission from the CPU 90 to transmit the key pad entries to the CPU 90. In addition, the I/O latch 122 controls light emitting diodes (LEDs) 120 and 132 which are triggered by CPU 90 to illuminate in various patterns whenever a bingo has been encountered on one of the bingo cards. An I/O latch of the type suitable for this purpose includes a data bus latch model no. PCF8584T manufactured and sold by Philips of Sunnyvale, Calif. and a pair key pad input latches, each keypad latch using model no. PCF8574T manufactured and sold by Philips of Sunnyvale, Calif.

A game key socket 134 connects in circuit with the data bus 96 and the CPU 90. When the game key 42 is inserted into the slot on the outside of the housing a game key plug 136 at the front end of the key 42 (FIG. 5) engages the socket to provide electrical communication between the data base and an electrically programmable read only memory (EPROM) circuit 138 having 128 kilobytes of memory located within the game key. The EPROM circuit 138 conventionally includes 16 address leads and 8 data leads to handle throughput of the 128 kilobytes of addressable data. Conventional high and low address latches are included to handle the sequential addressing of the memory circuit. An address latch low lead activates the first address latch for address bits 0–7. A separate address bit 8 is supplied directly from the data bus. An address latch high bit activates the second address latch for address bits 9–16. A data latch connects the EPROM data output to the data bus. A EPROM of the type suitable for this purpose manufactured and sold by AMD of Sunnyvale, Calif. under model no. 29F010. Addresses latches of the type suitable for this purpose are sold under model no. 75VHC573 by National Semiconductor of Santa Clara, Calif. A data latch of the type suitable for this purpose is sold under model no. 74LVX245 by National Semiconductor of Santa Clara, Calif.

In addition to linking the game key EPROM circuit 138 to the data bus 96, the plug 136 and socket 134 also connect a power lead 140 from a battery 142 and to a power lead 143 a power regulator 144. A connector lead 146 on the game key plug 136 connects the battery lead 40 in circuit with the power regulator lead 143; thereby, providing power to the bingo device hardware circuit.

The power regulator 144 actually includes three conventional voltage regulators with a main regulator providing the Vcc hardware circuit voltage and the LCD bias voltages. The game key EPROM circuit 138 connects to a second voltage regulator powered from the output of the first regulator. The power supply provides the necessary voltage level to erase the EPROM memory. A third voltage regulator provides an LCD bias voltage level that in cooperation with the main power supply provides the necessary bias voltages to the LCD display circuits.

THE CONTROL PROGRAM AND OPERATION

Main Program Routine

Figure 10:
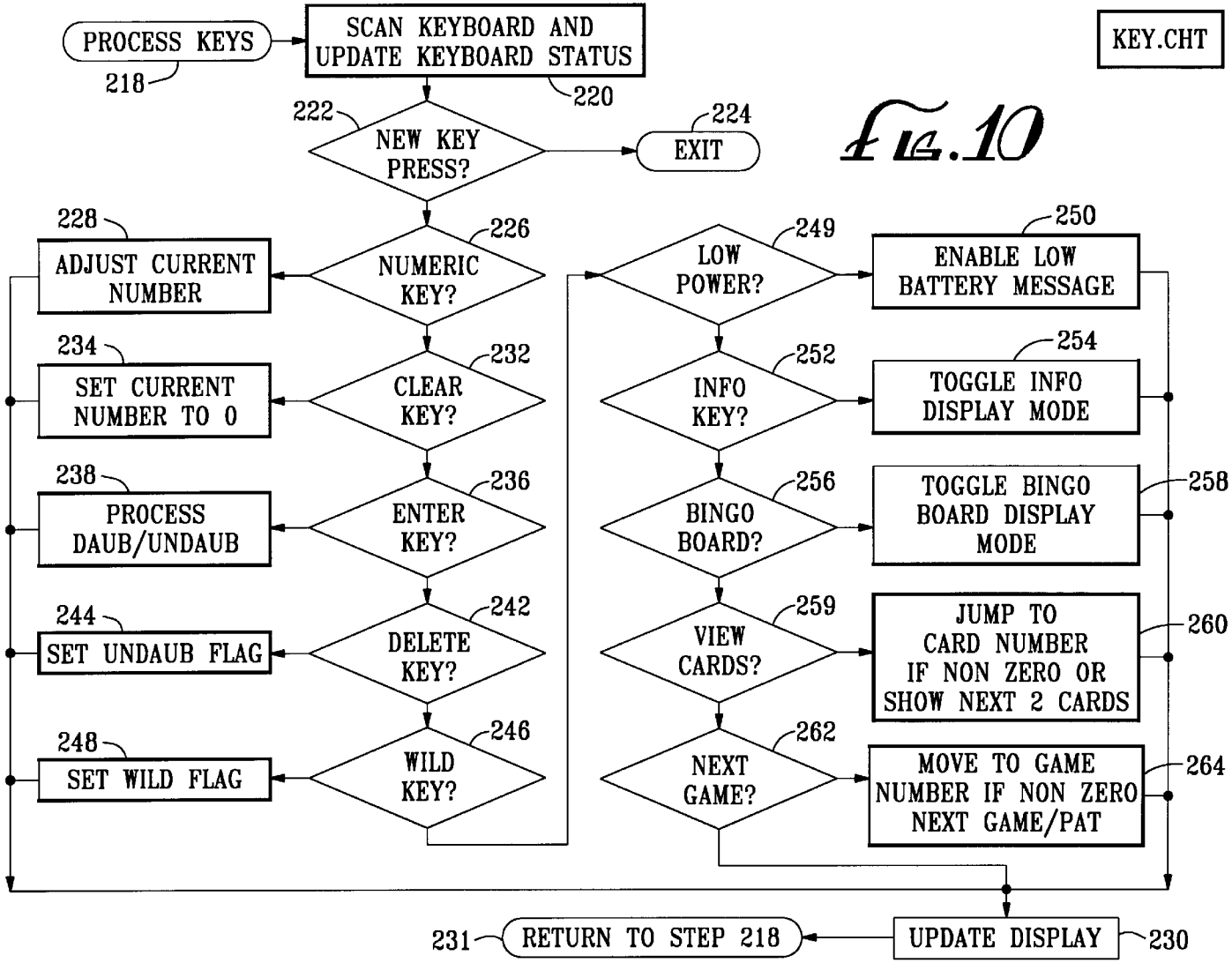

The control program source code is included herewith and incorporated by reference herein. The control program is started either upon inserting the game key into the game slot or at any time the CPU is reset by the watch dog timer at step 200. The program self tests and initializes the hardware in a conventional manner at step 202. The configuration information including the winning patterns, wild card numbers and bingo card allocation numbers are read from the EPROM memory at step 204. Next the bingo cards allocated to the player are compared with a checksum number to ensure the bingo card information in the ROM is valid at step 206. Each bingo card entry requires 13 bytes for card data and 3 bytes for providing a unique serial number to comply with various regional bingo regulations and a checksum byte. The checks is the sum of bytes 0 through 15 with a carry wraparound. If the sum of bytes 0–15 do not match the checksum value, the data is considered invalid and an error message is displayed on the graphic display at step 208 and the program stops at step 210. Otherwise, if the bingo card data is valid, the program resets a game pointer variable to the first game listed in the game key at step 212. The game data including winning patterns and wild card data is loaded into the game variable to initialize the game at step 214. The program at step 216 then calls a process keys subroutine 218 (FIG. 10). Upon return from the process keys routine 218, the program terminates at step 219.

Process Keys Routine

The process keys subroutine 218 continuously repeats during game play and scans the key pad for player input at step 220. If a new key of key code is not detected at step 222. The program returns to the process key routine 218 at stop 224. Otherwise, the routine attempts to identify the key. The remainder of the process keys subroutine 218 scans to check for valid entries of keys by a player. The numeric keys 0–9 are scanned for an entry at step 226. If the number is entered the entered number variable is updated at step 228 and next the graphic display is updated at step 230 and the program returns at step 231 to the process keys step at 218. Otherwise a clear key is checked at step 232. If the clear key has been pressed the entered number variable is cleared to zero at step 234 and next the graphic display is updated at step 230 and returns to step 218. Otherwise a enter key is checked at step 236. If the enter key has been pressed the daub/undaub main routine at 240 is executed at step 238 and next the graphic display is updated at step 230 and returns to step 218. Otherwise a delete key is checked at step 242. If the delete key has been pressed a undaub flag is set at step 244 and next the graphic display is updated at step 230 and returns to step 218. Otherwise a wild key is checked at step 232. If the wild key has been pressed a wild flag is set at step 248 and next the graphic display is updated at step 230 and returns to step 218. Otherwise a low power signal is checked at step 249. If the low power has been enabled by the watch dog circuit a "low battery message" is enabled at step 250 and next the graphic display is updated at step 230 and returns to step 218. Otherwise an Info key is checked at step 252. If the Info key has been pressed the information display mode is changed at step 254 and next the graphic display is updated at step 230 and returns to step 218. Otherwise a Bingo Board key is checked at step 256. If the Bingo Board Key has been pressed, the Bingo Board display mode is changed at step 258 and next the graphic display is updated at step 230 and returns to step 218. Otherwise a view cards key is checked at step 259. If the view cards key has been pressed the entered number variable is cleared to zero at step 260 and next the graphic display is updated at step 230 and returns to step 218. Otherwise a Next Game key is checked at step 262. If the Next Game key has been pressed for at least seven seconds, the next game number is updated in the at step 264 and next the graphic display is updated at step 230 and returns to step 218.

Daub/Undaub Main Routine

Figure 11:
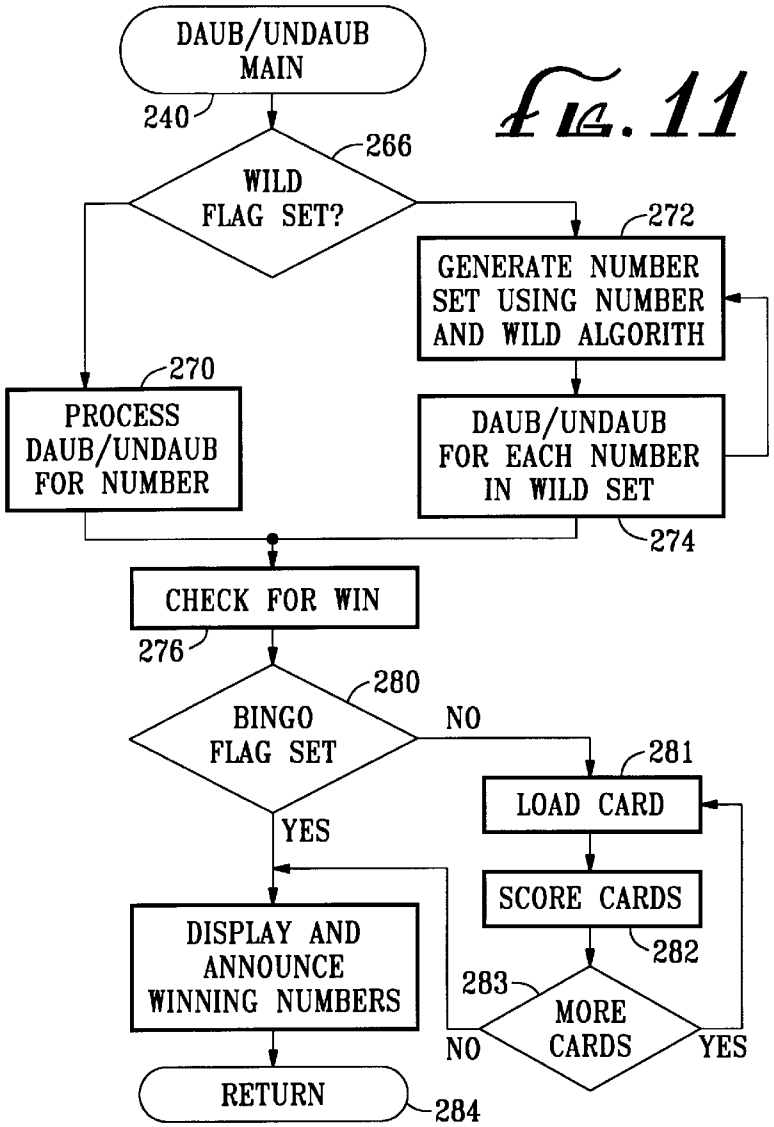
Figure 12:
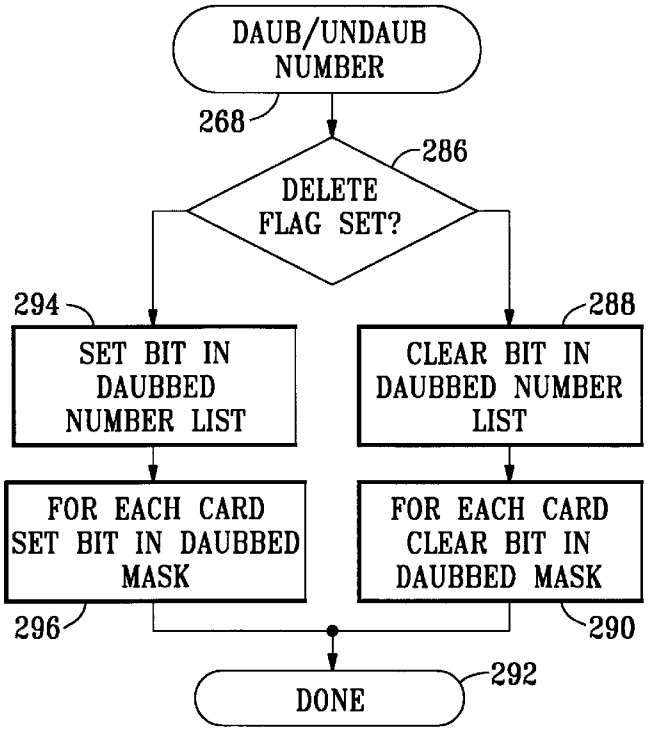

The Daub/Undaub Main Routine 240 (FIG. 11) is activated upon detecting an enter key at step 236 of the process key routine 218 (FIG. 10). If the enter key has been pressed, and the last key entered was a number, the number stored in the entered number variable is added to the list of called numbers and the number is marked on each card containing that number. If the wild key was pressed prior to pressing the enter key, the number entered will be used to mark all numbers meeting the requirements of the wild card rules. The Daub/undaub main routine 240 checks if a wild key has been pressed at step 266. If no wild card is found the program jumps to a Daub/Undaub number routine 268 (FIG. 12) at step 270. Otherwise, the program generates each valid number from the wild card algorithm at step 272 and jumps to the Daub/Undaub number routine at 274. Steps 272 and 274 are repeated until every number from the wild card set has been daubed. Next the routine checks for a winning card at step 276. The check for win at step 276 calls a check for win routine 278. A bingo flag is set by the check for win routine when bingo has been found and upon return a check for bingo flag set step is performed at step 280. If bingo occurs a bingo card is loaded at step 281 and a score cards routine is called at step 282. Next, the routine checks if all cards have been scored at step 283, if not the program returns to step 281; otherwise the program returns at step 284 to the process keys routine 218. If the bingo flag is not set at step 280, the program just returns to the process keys routine at step 284. Then the program returns to the process key routine 218 and the graphic display is updated at step 230 and then the program returns to step 218.

Daub/Undaub Number Routine

The Daub/Undaub number routine 268 marks each of the bingo cards in play with a match to the called numbers. The program checks whether a delete key flag was entered at step 286, if yes then the bit in the daubed number list is deleted at step 288 and the number is unmarked for each of the bingo cards at step 290 and next returns to the Daub/Undaub Main Routine at step 292. Otherwise, the number is added to the daubed number list at step 294 and the number is marked for each of the bingo cards at step 296 and next returns to the Daub/Undaub Main Routine at step 292.

Check For Win Routine

Figure 13:
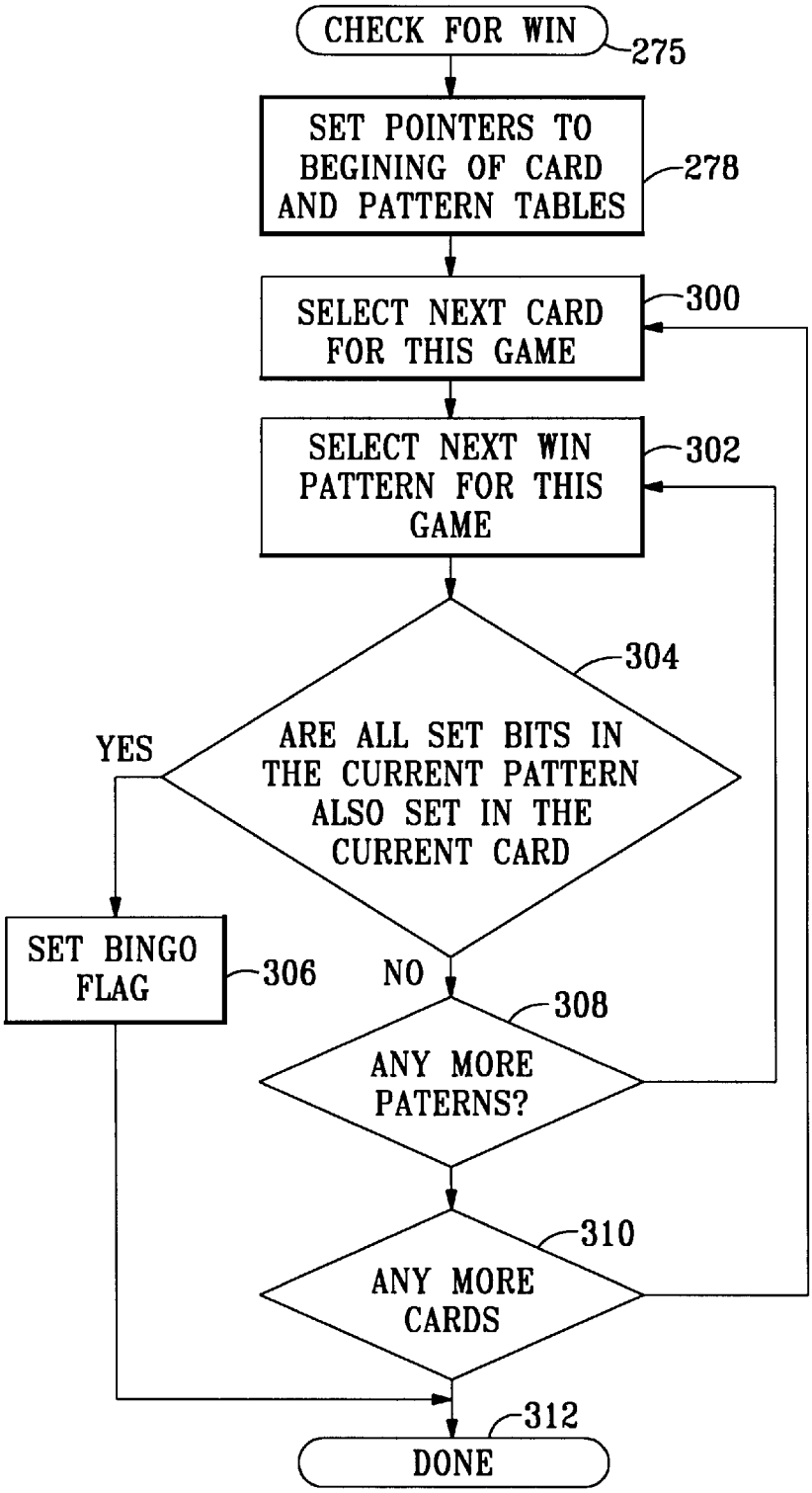
Figure 14:
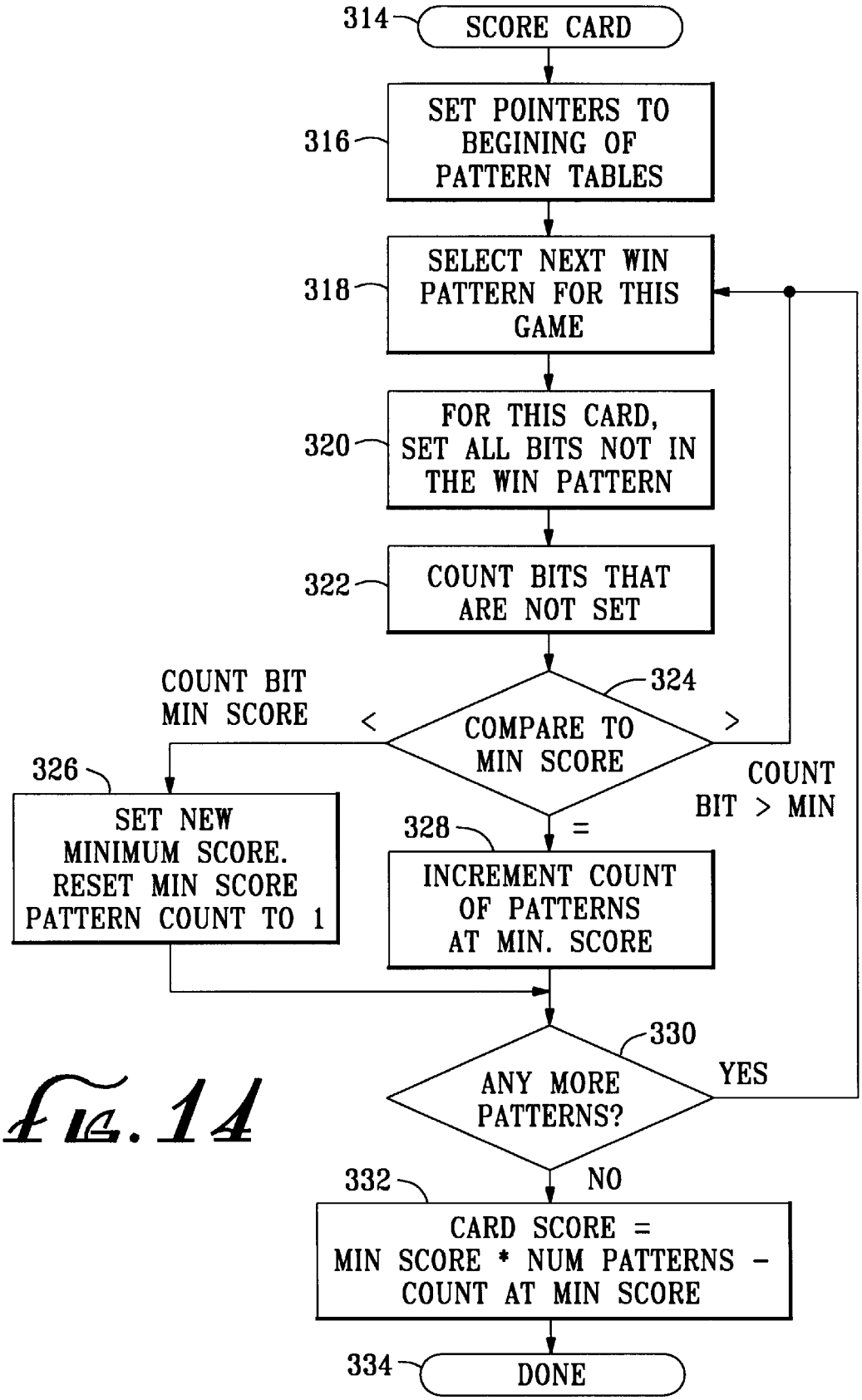
Figure 15:
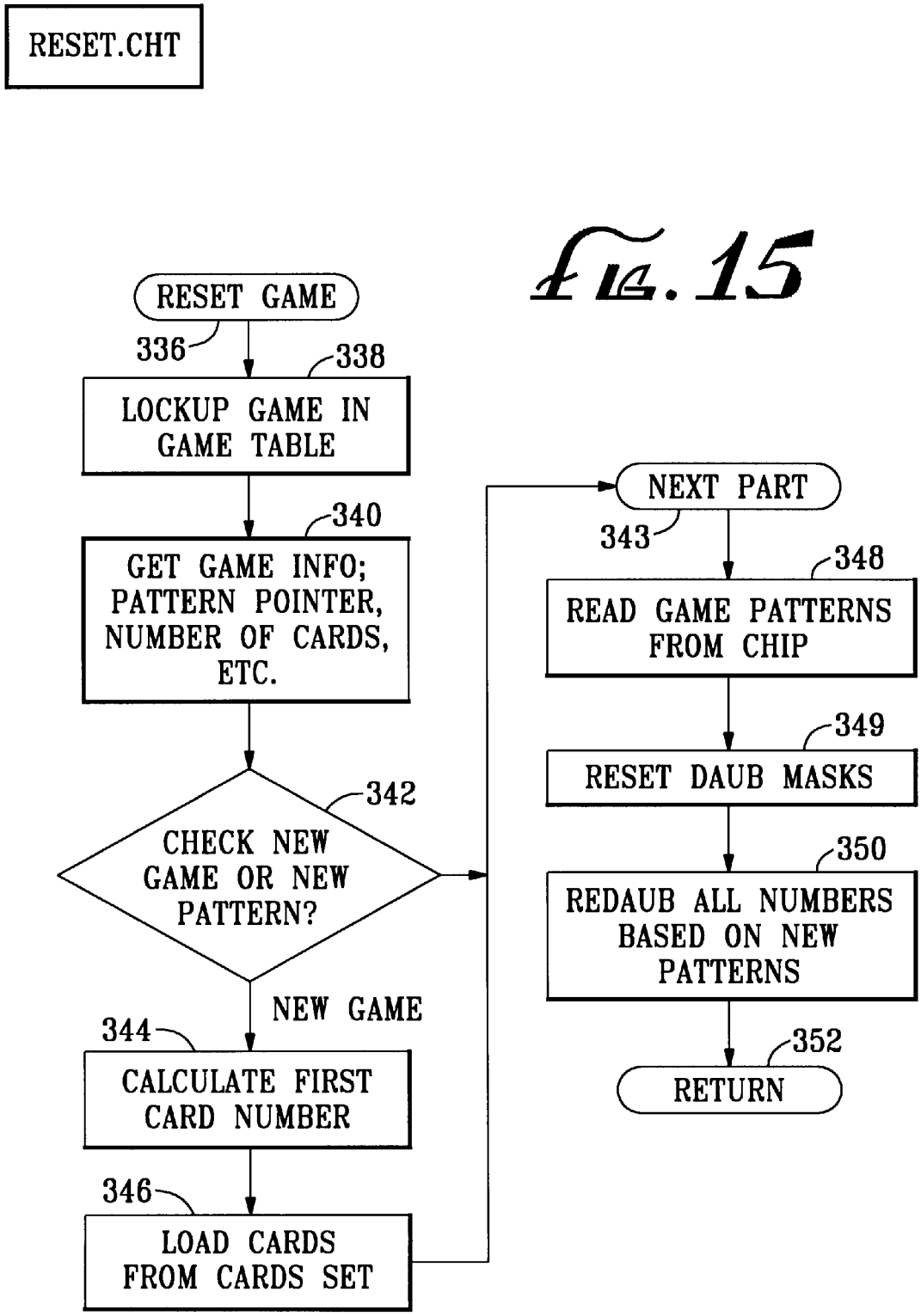
Figure 16:
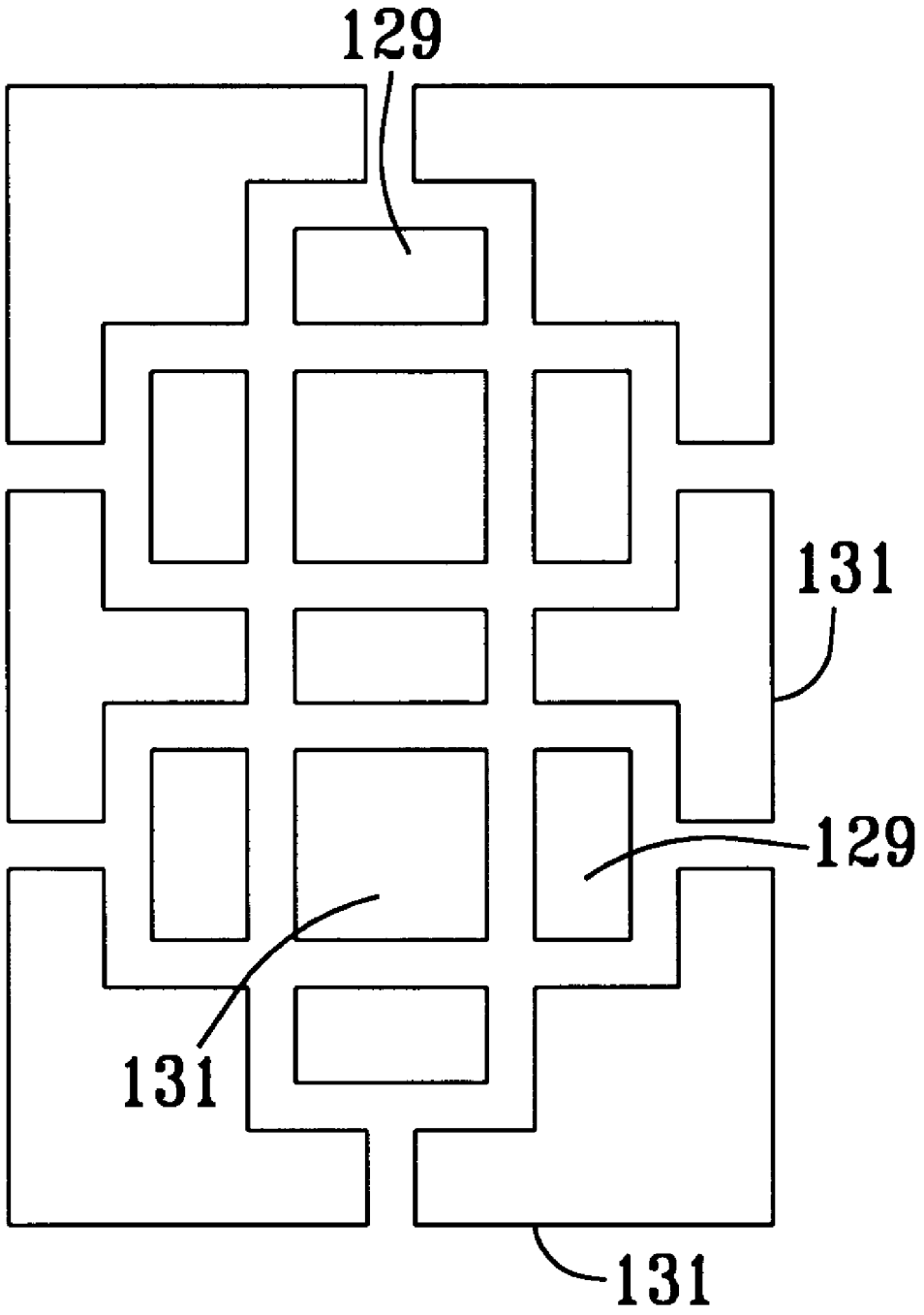
FIG. 16 is a schematic diagram of the LCD for the bingo displays.

The check for win routine 276 (FIG. 13) sets the pointers for winning patterns in play and game to begin scanning for a win at step 298. A select next card loads the first card mark mask at step 300. A select next win pattern loads the next win pattern to be checked for this game at step 302. If the win pattern bits match bit in the bingo card mark mask at step 304, then the bingo flag is set to mark the win, the routine then returns to the Daub/Undaub Main routine at step 312. Otherwise, more patterns are checked at step 308. If there are more patterns then the program returns to step 302. Otherwise more cards are checked at step 310, if more cards exist the program returns to step 300. Otherwise the program returns to the Daub/Undaub Main Routine at step 312.

Score Card Routine

The score card routine 314 checks whether the loaded card has earned Bingo. The pointers that track the winning patterns are first set to the beginning at step 316. Next, the next winning pattern is loaded to be compared with the bingo cards at step 318. The card mask bits are set to "on" or a "1" at step 320 and the bits not set are counted at step 322. The number of not set bits are compared to a minimum score variable at step 324. If the card bit are less than the minimum score, then the minimum score is updated to the value of the bit count form step 322. The minimum score pattern count is then updated. The program then jumps to step 330 to check for more patterns. If the comparison of the minimum score to the counted not set bits is equal, then the count of patterns at min. score is incremented and the program jumps to step 330. If the count bit are greater than the minimum score the program returns to step 318. At step 330, if there are more patterns the program jumps to step 318; otherwise the card score is updated at step 332. The card score is equal to the minimum score multiplied by the number patterns minus the count at minimum score. The program then returns to the Daub/Undaub Main Routine at step 334.

Reset Game Routine

The reset game routine 336 loads in the winning pattern information for the part of a continuing game or loads in the winning patterns for a new game. The next game information is loaded from the game table at step 338 and gets the game info including the pattern pointer and number of cards and wild card data for the game at step 340. A check is made to determine whether this information is a new game or a new part of an existing game at step 342. If the game information is a new part of an existing game the routine jumps to step 343.

Otherwise, the routine sets up the bingo device to play a new game. A first card number is calculated at step 344 to determine how many cards have been allotted from the bingo card memory for this game at step 344. Then the corresponding number of bingo cards are loaded from the list of bingo cards at step 346. The program then jumps to step 343 to load in the winning pattern information and wild card information for the next round of play. Winning patterns from the Game Key are read at step 348. Next, recheck for a win using the new win patterns at step 349 using the check for win routines. Finally, all numbers are rescored based on the new patterns at step 350 by jumping to the score card routine until all cards have been scored. The program then returns to the process key routine 218 at step 352.

A source code program including files: for carrying out these routines is included herewith and incorporated herein by reference and may be compiled for use on the disclosed hardware by using the standard libraries included on a Borland C++ Ver 5.0 compiler and paradigm locate which is a software tool for converting the executable for transfer to an RPROM.

Operation

Enabling the terminal

The terminal will be disabled until a player inserts a memory card. This card contains the number of games authorized for that player, the number of cards to be played each game, and the winning patterns which valid for each game. Each Bingo Terminal contains a list of cards. The details of the storage of this information is covered in a later section.

Starting Play

When the player presses and holds the Game Key followed by a number and ENTER. A new game is selected. Pressing the game key momentarily caused the screen to be blanked except for the current game number displayed in the center of each card.

Entering Numbers

Pressing one or two numbers followed by the ENTER key will cause that number to be daubed. A list of all daubed numbers may be displayed by pressing and holding the BINGO BOARD button.

Removing Incorrect Numbers

If a number is displayed on the bingo board that has not been called, it may be removed by pressing the one or two digit number and DELETE.

Showing all called numbers.

Pressing and holding the BINGO BOARD button will cause all numbers that have been entered to be displayed. The normal display will return when the BINGO BOARD button is released.

BINGO

If all the numbers on one of the cards in play that fill a pattern are selected, the audible alarm will sound and the numbers on that card that form the winning pattern will flash. All buttons will continue to operate so that corrections can be made if the bingo is the result of an erroneous entry. During the time that the BINGO is detected, the serial number of the card may be displayed by pressing the GAME KEY. Pressing the GAME KEY again will return to the regular numeric display.

Wild Numbers

Some games allow for Wild numbers to be entered at the beginning of a game. These numbers are daubed by entering a number followed by the Wild Button, follows by the Enter key. they may be undaubed by entering the number, followed by the Wild Button, followed by the Delete key. The following sections list the wild algorithms that may be used: The wild algorithm is selected per game as determined by the house. The algorithm to be used in each game is stored in the memory card that configures the computer for play. When the wild number is entered a group of numbers is daubed simultaneously based on the selected wild algorithm which may be one of the following:

Even/Odd

If the number entered is even, all even numbers on the card will be daubed. If the number entered is odd, all odd numbers on the cards will be daubed.

Ending-In

All cards ending in the same number will be daubed.

Determining the number of a card

A bingo card consists of 5 columns of 5 numbers. In the first column, five numbers from the range of 1 to 15 may be arranged in any order. In the second column, five numbers from the range 16 to 30, in the third 31 to 45, in the fourth 46 to 60, in the fifth 61 to 75. Thus in the first position there are 15 possible numbers. In the second, there are 14 (the one number chosen for the first position cannot be reused), in the third there are 13, etc. In the second column, the sequence is repeated. In this way, a sequence on 25 numbers ranging from 1 to 15 uniquely identify a card.

(15,14,13,12,11,15,14,13,12,11,15,14,13,12,11,15,14,13,12, 11, 15,14,13,12,11) Each column thus has the potential of 360,360 different combinations and the total number of different cards is 6.0796911214672e+27.

The number of a card is arrived in the following way.

1. Renumber the card by removing the minimum possible value of a number in a column for all numbers in that column (i.e. Subtract 1 from all numbers in column 1, 16 from all numbers in column 2, 31 from all numbers in column 3, 46 from all numbers in column 4, and 61 from all numbers in column 5). When complete, all numbers be between 0 and 14.

2. Renumber again in the following manner. For each column, make a list of numbers from 0 to 14. For the first row of each column, replace the number in the card cell by the location in the list where that number is found. Then shorten the line by removing that number. Repeat this process with the shortened list on the next number. And then with the still shorter list on the third number, and the fourth and the fifth.

3. Combine these numbers according to the following formula, where Cn is the number from the above table and Xn is the number from the renumbered bingo card.

$$CannoicalNumber = X_0 + \sum_{i=1}^{24} Xi * \left( \prod_{j=0}^{i} Cj \right)$$

Identifying Winning Patterns

Winning patterns can consist of from 1 to 25 positions on a card. This can be identified by a vector of 25 bits. A one bit in any position indicates that the position on the card corresponding to that bit is required by that pattern. For example, the following win mask identifies the common bingo pattern of all numbers in the first column being daubed:

0000000000000000000011111

And this win mask identifies the pattern of all numbers in the first row being daubed.

0000100001000010000100001

These numbers can be conveniently fit in a long integer (32 bits). The upper 7 bits are reserved.

Configuring a Bingo Device

Each Bingo Device is preconfigured with a set of preferably 1000 cards. This information is stored in an internal flash PROM and is programmed by factory equipment at the time of manufacture. These cards are stored in a table with entries of the form:

Configuring a Players Aid

Each terminal is preconfigured with a set of 1000 cards. This information is stored in an internal flash PROM and is programmed by factory equipment at the time of manufacture. These cards are stored in a table with entries of the form:

| Function | Canonical Card Representation | | Ser. No. | Checksum |
|---|---|---|---|---|
| Byte | 0 | 12 | 13 15 | 16 |

The canonical card representation is discussed in section 4.4. The Ser. No. is a number assigned to the card in the master cardset. The checksum is the sum of bytes 0 through 15 with carry wraparound.

Game Key Information

This information is stored in tables. These tables are described in the following subsections.

Win Pattern Table

The win pattern table contain a list of all winning patterns. Note that most winning patterns may require multiple entries in the table. For example, the standard bingo winning pattern of any row, any column, or the two diagonals would require 12 entries. One for each of the 5 rows; one for each of the 5 columns, and one for each of the two diagonals.

Each entry in the win pattern table is in one of the following two formats:

Pattern Mask

| Function | 0 | 0 | 00000 | Win Pattern | |
|---|---|---|---|---|---|
| Bit | 31 | 30 | 29 25 | 24 | 0 |

Group Header

| Function | 0 | 1 | Start Pattern | Number of Patterns | |
|---|---|---|---|---|---|
| Bit | 31 | 30 | 29 25 | 24 | 0 |

The entries are arranged in an array with 0 referring to the first element in the array. The number of entries in this table is limited only by the memory in the programming plug.

Win Mask 0
Win Mask 1
.
.
.
Win Mask N

Game/Part Table

The authorized game numbers, the number of games, the winning patterns for each game are provided in the game key. There are two formats for this table the game header and the part header. Single part games will have one game header, followed by one part header. Multipart games will have one game header followed by as many part headers as there are parts to the game. The format of these two headers are as follows:

Game Header

| Function | 0 | 1 | Game Number | Number of Parts | Number of Cards | 00000000 | |
|---|---|---|---|---|---|---|---|
| Bit | 31 | 30 | 29 25 | 24 16 | 15 8 | 7 | 0 |

Part Header

| Function | 0 | 0 | Wild Algorithm | Part Number | Pattern | |
|---|---|---|---|---|---|---|
| Bit | 31 | 30 | 29 25 | 24 16 | 15 | 0 |

Scoring Cards

In bingo, all that really matters for winning is if a pattern is complete. The card either has a pattern completed or it does not. But, in order to determine which are the best card in play, it is necessary to give each card a score. This score will be determined as follows:

Cards are first scored by the pattern closest to a win. For example a card that is one away from winning on some combination is better that a card that has no combination better than two away.

The cards that are at any given rank are then further ranked by how many different combination are at the minimum. For example a card that is one away on two different patterns is better that one that is one away o only one pattern.

Lastly any ties are broken by where the card was in the previous ranking This prevents the cards from jumping around in order when the score has not changed as a result of sorting them.

These scores are combined as follows:

$Score = (D_{on} * N_{patterns} - N_{on}) * N_{cip} + R_{old}$

Where:

$D_{on}$ Number of numbers required for win on the best pattern on this card.

$N_{patterns}$ Number of win patterns in the current game.

-continued

| | |
|---|---|
| $N_{on}$ | Number of patterns that are at Don from a win. |
| $N_{cip}$ | Number of cards in play in this game. |
| $R_{old}$ | Card rank after last scoring pass. |

The Scores are then ordered from best to worst. The best is assigned Rank 0 and each card is assigned a successively higher rank in order of its score with the worst receiving a rank of NumCards-1.

After the first ranking all the scores will be unique since Old Rank is unique.

Selection of the Card Set

There are a number of desirable characteristics for good cards.

1. All cards in play should be different.
2. As much as possible, all rows should be different.
3. As much as possible all columns should be different.
4. Each row and column should have equal numbers of odd and even digits, or a 2:3 proportion.
5. A given row should have only one number ending in a given digit. For example, 15 and 25 should not appear in the same row.
6. A given column should have only one number ending in a given digit.
7. Sequences of sequential number should not appear.

The most difficult row and column to meet this criteria are the center row and columns since the free space in the center reduces the number of permutations for those row and columns to 4, and thus limits the number of valid combination for them to about 10,000. Therefore, for large cardsets, the restriction that these two rows and columns cannot be repeated in the cardset will be waived.

The following procedure then can be used to generate a cardset:

1. Generate all valid long column permutations that meet the above requirements.
2. Generate all valid short column permutations that meet the above requirements.
3. Generate all valid long row column permutations that meet the above requirements.
4. Generate all valid short row permutations that meet the above requirements.
5. For each short column, randomly pick 4 long columns.
6. Check to insure that all rows generated from the above selection are in the row list. Repeat the above step if not.
7. Add the card to the card list. Remove all used rows and columns from the row and column lists to insure that they won't be used again.
8. Continue from step 5 until all cards are generated.

The master cardset generated from the above procedure is then divided into sets of 1000 cards for each unit. After all the cards are used, new card sets are generated by starting with an offset of 100, then 200, etc. In this manner, 100 unique handset cardsets can be generated from 10,000 cards. 200 from 20,000, etc.

It will be understood that certain features and sub-combinations are of utility and may be employed without reference to other features and sub-combinations as they are outlined within the claims. While the preferred embodiment and application of the invention has been described, it is apparent to those skilled in the art that the objects and features of the present invention are only limited as set forth in claims attached hereto.

What is claimed is:

1. An electronic game apparatus comprising:

a central processing unit;

a non-volatile memory connected to said central processing unit;

said non-volatile memory having a computer program that when executed by the central processing unit configures the central processing unit to monitor bingo cards during a game of play;

a data storage unit;

a user interface connected to said central processing unit;

a game key having data representative of a set of games and game parts, a set of winning patterns for each game, a set of wild card identifiers for each game, an identifier for the number of bingo cards in play;

data representative of a plurality of a plurality of bingo cards stored in said nonvolatile memory; and wherein said game key having said data representative of said identifier for the number of bingo cards in play corresponds to a numeric allocation of bingo cards selected from said data representative of said plurality of bingo cards;

wherein said data storage unit includes data representative of player scores.

2. The electronic game apparatus of claim 1 including:

means for randomly selecting a number of bingo cards from data representative of a plurality of bingo cards corresponding to said identifier for the number of bingo cards in play.

3. The electronic game apparatus of claim 2 further including:

data representative of a unique identification label for said bingo cards;

means for storing date representative of player scores determined by said apparatus from said set of winning pattern data, said winning number data and said selected set of randomly selected bingo cards;

such that combining said removable game key with said electronic game apparatus enables said apparatus to emulate a bingo game.

4. The electronic game apparatus of claim 1, wherein said user interface includes:

a display adapted to display a plurality of bingo card patterns.

5. The electronic game apparatus of claim 4 including said display having at least four display screens adapted to display a corresponding number of bingo card patterns simultaneously.

6. The electronic game apparatus of claim 5 including said display having a supplemental display adapted to provide alphanumeric messages.

7. An electronic game apparatus comprising:

a central processing unit;

a non-volatile memory connected to said central processing unit;

said non-volatile memory having a computer program that when executed by the central processing unit configures the central processing unit to monitor bingo cards during a game of play;

a user interface connected to said central processing unit;

a game key having data representative of a set of games and game parts, a set of winning patterns for each game, a set of wild card identifiers for each game, an identifier for the number of bingo cards in play;

means for randomly selecting a number of bingo cards from data representative of a plurality of bingo cards corresponding to said identifier for the number of bingo cards in play; and data representative of a unique identification label for said bingo cards;

means for storing date representative of player scores determined by said apparatus from said set of winning pattern data, said winning number data and said selected set of randomly selected bingo cards;

such that combining said game key with said electronic game apparatus enables said apparatus to emulate a bingo game.

8. The electronic game apparatus of claim 7, wherein said user interface includes:

a display adapted to display a plurality of bingo card patterns.

9. The electronic game apparatus of claim 8 including said display having at least four display screens adapted to display a corresponding number of bingo card patterns simultaneously.

10. The electronic game apparatus of claim 9 including said display having a supplemental display adapted to provide alphanumeric messages.

11. The electronic game apparatus of claim 7 including a data storage unit having data representative of player scores.

12. An electronic game apparatus comprising:

a central processing unit;

a non-volatile memory connected to said central processing unit;

said non-volatile memory having a computer program that when executed by the central processing unit configures the central processing unit to monitor bingo cards during a game of play;

a user interface connected to said central processing unit;

a game key having data representative of a set of games and game parts, a set of winning patterns for each game, a set of wild card identifiers for each game, an identifier for the number of bingo cards in play;

said user interface including a display adapted to display a plurality of bingo card patterns; and said display having at least four display screens adapted to display a corresponding number of bingo card patterns simultaneously.

13. The electronic game apparatus of claim 12 including said display having a supplemental display adapted to provide alphanumeric messages.

14. The electronic game apparatus of claim 12 including:

a data storage unit;

wherein said data storage unit includes data representative of player scores.

15. The electronic game apparatus of claim 12 including:

means for randomly selecting a number of bingo cards from data representative of a plurality of bingo cards corresponding to said identifier for the number of bingo cards in play.

16. The electronic game apparatus of claim 15 further including:

data representative of a unique identification label for said bingo cards;

means for storing date representative of player scores determined by said apparatus from said set of winning pattern data, said winning number data and said selected set of randomly selected bingo cards;

such that combining said removable game key with said electronic game apparatus enables said apparatus to emulate a bingo game.

* * * * *